US005163371A

United States Patent [19]

Kotterer et al.

[11] Patent Number: 5,163,371

[45] Date of Patent: Nov. 17, 1992

[54] METHOD AND A DEVICE FOR CATCHING A PRINTED WEB AFTER BREAKAGE

[75] Inventors: Werner J. Kotterer; Josef Öttl, both of Diedorf; Werner Kettl, Neusäss, all of Fed. Rep. of Germany

[73] Assignee: Grafotec Kotterer GmbH, Diedorf, Fed. Rep. of Germany

[21] Appl. No.: 743,766

[22] Filed: Aug. 12, 1991

[30] Foreign Application Priority Data

Sep. 15, 1990 [DE] Fed. Rep. of Germany ..... 4029366

[51] Int. Cl.[5] ..... B41F 13/54

[52] U.S. Cl. ..... 101/484; 101/219; 101/228; 226/11; 226/42

[58] Field of Search ..... 226/11, 45, 124, 42; 101/224–228, 219, 232, DIG. 41, 219, 484

[56] References Cited

U.S. PATENT DOCUMENTS

| | | | |
|---|---|---|---|
| 2,838,303 | 6/1958 | Morley | 226/11 X |
| 3,404,627 | 10/1968 | Halley | 226/11 X |
| 4,508,033 | 4/1985 | Fischer | 101/217 |
| 4,549,485 | 10/1985 | Nawrath | 101/219 |
| 4,846,060 | 7/1989 | Proctor | 101/228 |
| 4,920,879 | 5/1990 | Leguillochet et al. | 101/219 |
| 5,036,765 | 8/1991 | Keilhau | 101/228 |

*Primary Examiner*—Edgar S. Burr
*Assistant Examiner*—Christopher A. Bennett
*Attorney, Agent, or Firm*—Jones, Tullar & Cooper

[57] ABSTRACT

In order to catch a broken printed web, which is gripped downstream from a printing unit, and more particularly downstream from the last printing unit of a roll feed rotary printing press, between a driven roll and at least one yoke which is able to be pivoted against the roll in response to the signal of a switch sensing breaking of the web, to ensure a high degree of operational reliability, the roll is initially run at a higher speed than the web and then the effective speed of the roll is made equal to the web speed by the use of a drive device with at least one yielding means therein, the torque transmitted to the yielding means being reduced to a value lower than the web break value at the earliest when the yoke comes into engagement with the roll.

9 Claims, 2 Drawing Sheets

METHOD AND A DEVICE FOR CATCHING A PRINTED WEB AFTER BREAKAGE

BACKGROUND OF THE INVENTION

The invention relates to a method of catching a broken printed web which is gripped downstream from a printing unit and more particularly downstream from the last printing unit of a web feed rotary printing press between a driven roll and at least one rotor which is able to be pivoted against the roll in response to the signal of a switch sensing breaking of the web. Furthermore as seen from another aspect, the invention relates to an apparatus comprising a gripper device arranged following a printing unit and more particularly following the last printing unit of a web feed rotary printing press so that one side of the gripper device comprises a roll driven by a drive device and the other side comprises a rotor which is mounted on a carrier arranged to be moved by an engagement device into engagement with the roll in response to a switch sensing breaking of the web.

German patent publication 3,822,496 refers to a device of this type, in the case of which the roll is driven at the same speed as the printing press. If the web is not wound onto the roll, something that occurs when the web is not printed or is only printed to a slight extent, it is impossible with this known device to draw the web taut with the catching device after the web has necessarily already become loose after breakage, at the time it is caught. Therefore there is the danger of the web flying wildly around and/or of the web running up into contact with an adjacent cylinder of the printing mechanism which may lead to a wrap-around. If in fact the web wraps onto the roll of the web catching device, and this is to be expected in the case of a heavily printed web, the resulting increase in the effective diameter of the roll will mean that the surface speed is greater than the speed at which the web is able to be supplied so that it will break off again, even though the web is loose after the first break. The tension force acting on the web is however not limited and there is the danger of breakage and a second wrap-around. The arrangement described in the German patent publication 3,822,496 is therefore not sufficiently reliable.

German patent 3,215,473 relates to a device of the type described in the case of which the roll is to be driven at the same speed as the web or slightly faster. The drive device associated with the roll is however inherently rigid so that during the time in which the arrangement is slowed down to a halt there is the same ratio between the speeds of the web and the roll. In this respect as well there is therefore the danger that the web will be drawn excessively tight and accordingly be broken off again if the printing press is not braked sufficiently promptly.

SUMMARY OF THE INVENTION

Accordingly, one object of the invention is to avoid the disadvantages indicated and to so improve on the method of the type initially mentioned that safety and reliability are increased.

A still further aim of the invention is to provide a simple device which is low in price and is suitable for performing the method of the invention.

In order to attain the first object of the invention, the roll is initially run at a higher speed than the web and then the effective speed of the roll is made equal to the web speed by the use of a drive device with at least one yielding means therein and the torque able to be transmitted at the yielding means is reduced to a value under the web break value at the earliest when the rotor comes into engagement with the roll.

In order to attain the second object of the invention, the drive device, which is associated with the roll, and whose speed, which is able to be reduced under load, is set to an overspeed value, that is to say a value higher than the web speed, comprises at least one torque transmission member, whose effective transmission torque is adjustable and which is able to be adjusted by the action of a sensor coordinated with the position of the rotor near the roll from an upper value to a minimum value under the web break limit.

With respect to the member having an adjustable transmission torque these features lead to the desired elasticity of the drive device which is necessary in order to rapidly draw and hold taut the web without exceeding the permissible web tension.

Advantageous features and developments of the invention are recited in the claims. Thus for instance it is particularly advantageous to have a torque transmission element with an adjustable torque in the form of an electrical element including a magnetic force transmitting means. These features make possible a simple control system.

In accordance with a further and particularly preferred development of the invention the torque transmission member having an adjustable torque value is in the form of a drive motor which is able to be braked under load, that is to say preferably in the form of a DC servo motor, whose speed is set to be higher than the speed of the web and whose torque is able to be reduced by the action of the sensor. In this respect there is the advantage that the speed of the motor may be controlled on the basis of the voltage and the torque on the basis of the amperage. The use of an individual drive motor furthermore ensures that fitting of the apparatus in accordance with the invention in pre-existing equipment is possible without having to modify the drive of the printing press. Fitting of the device in accordance with the invention to upgrade such pre-existing machinery is hence able to be undertaken quickly and cheaply.

Further advantageous features and developments of the invention will be gathered from the following more detailed account of one embodiment of the invention with reference to the drawing.

DETAILED DESCRIPTION OF A PREFERRED EMBODIMENT OF THE INVENTION

Figure 1:
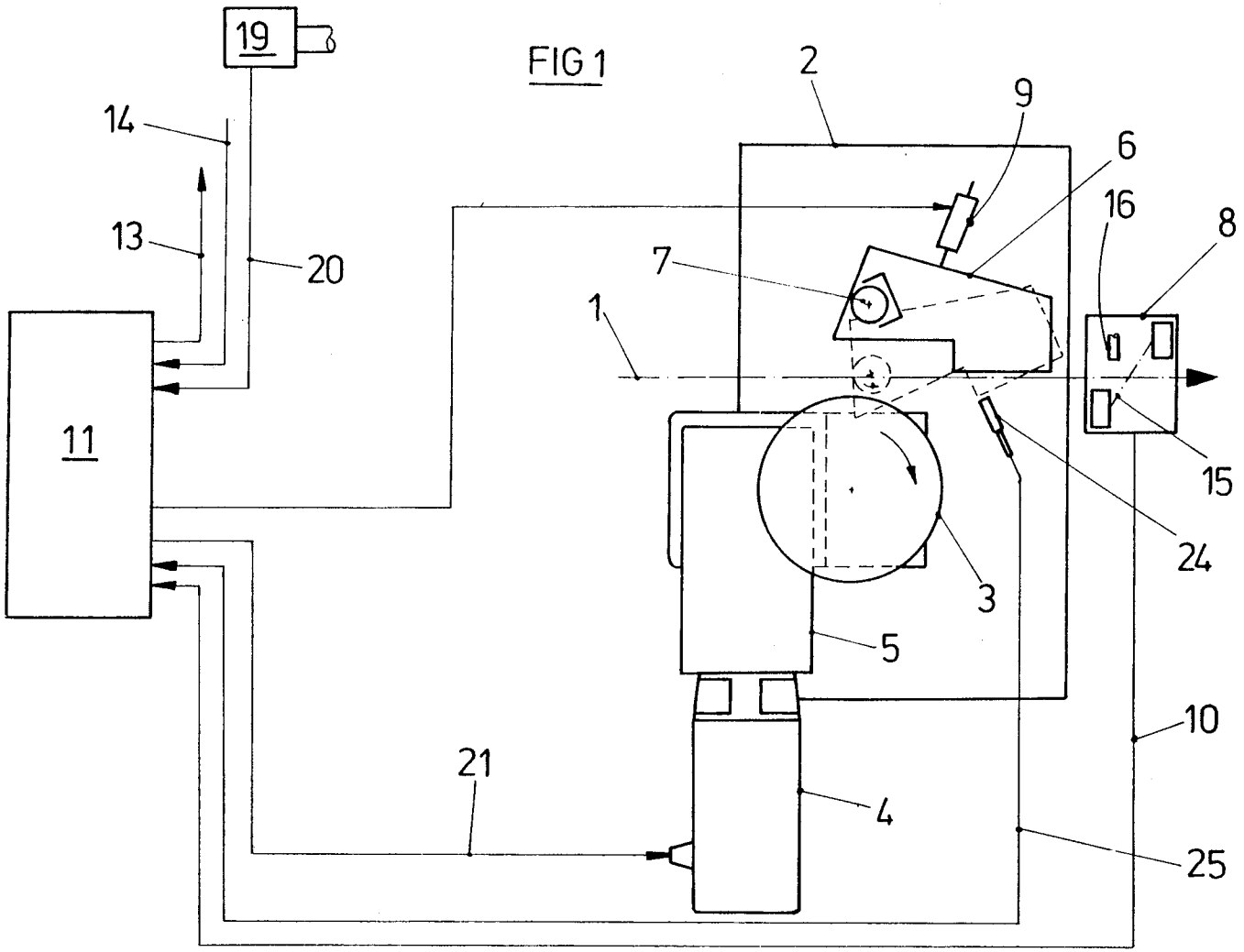
FIG. 1 shows a diagrammatic side view of a web catching device in accordance with the invention.

A paper web 1, which is printed in a web feed printing press, not illustrated, runs in accordance with FIG. 1 through a web catching device which may be positioned between the last printing unit and a dryer following it. However it would also be possible to provide such a web catching device on the output side of each printing unit. The present web catching device consists of a frame 2, on which a roll 3 is mounted by a bearing and over which the web 1 runs. The roll 3 is driven in the direction of the arrow by an associated drive motor 4 with an output transmission 5. A yoke 6 is pivotally mounted to the frame 2 and over the web 1. It carries a plurality of freely rotatable rolls 7 with a low inertia and mounted on a shaft parallel to the roll 3.

In the event of the web breaking, the yoke 6 will be pivoted out of the standby position indicated by full lines into the working position shown in broken lines, in which the rolls 7 come into engagement with the roll 3 so that the web 1 placed between the same is pressed against the driven roll 3. The web 1 is accordingly either wound up on the roll 3 or is deposited underneath the roll 3. The yoke 6 is able to be smartly pivoted by means of an engagement device 9, as for instance an engagement device in the form of a tensioned spring, when the engagement device is triggered by a web break switch 8. The output signal of the web break switch 8 is in this case, as is indicated by the signal conductor 10, supplied to a control device 11, by means of which the engagement device 9 is able to be operated. Simultaneously, the printing press is braked by the control device 11 so that from the time of response of the web break switch 8 the machine speed will decrease. The signal conductor for the signal for the braking operation is marked 13. The activation of the control device 11 at the start of operation or, respectively, when the press is restarted, may be via a signal conductor 14.

The web break switch 8 may be in the form of a photoelectric detector 15 sensing the edge of the web 1 and a deflecting device 16, for instance in the form of a blowing nozzle, for shifting the sensed edge of the web, when the tension of the web is reduced. Such a web break switch has a very short response time and produces electrical output signals, which may be readily processed.

The electrical drive motor 4 associated with the roll 3 is in the present case in the form of a three-phase servo motor, whose output torque may be adjusted by resetting the level of the input amperage and whose speed, at which the motor runs free of load or, respectively, the load up to the set torque, may be varied by changing the input voltage. As soon as the load becomes higher than the set torque the motor will be braked by the load. In this case the motor 4 will practically act as a spring.

Figure 2:
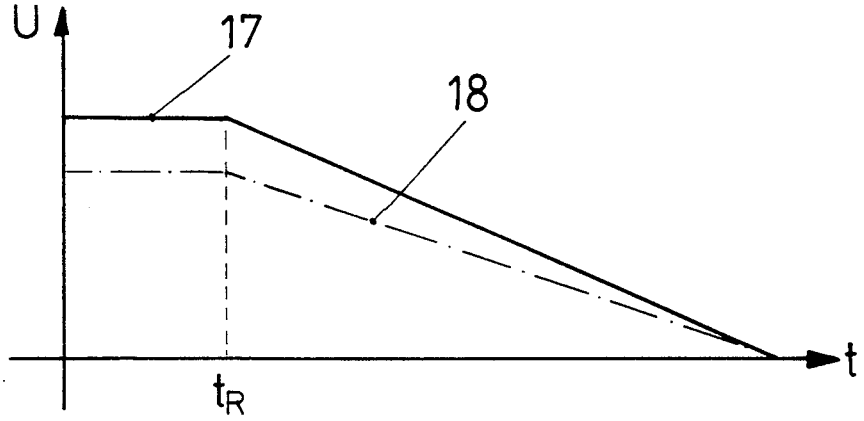
FIG. 2 is a graph in which motor voltage is plotted against time.

The roll 3 is driven by the motor 4 during normal operation in a way dependent on the speed of the printing press and consequently in a way dependent on the normal web speed, the speed in the present case being 15% higher, that is to say overspeed is used. The circumferential speed of the roll 3 is accordingly 15% greater than the web speed during normal operation. This overspeed is set, see the voltage against time graph of FIG. 2, since input voltage of the supply to the motor 4 is incremented to be higher than an initial value which is derived from the speed of the printing press and is shown in broken lines, by a constant value which here corresponds to the desired overspeed of 15%. This increment is, as shown in FIG. 2, present even when the initial value drops after response of the web break switch 8. The response time of the web break switch 8 is denoted $t_R$.

In order to establish the initial value shown in the broken line 18 it is possible to use a tachogenerator as shown in FIG. 1 at 19 and which is able to be driven by a driven element of the printing press. The output signal of the tachogenerator 19 is applied, as shown in the figure, by the signal conductor 20 to the control device 11. The latter is so programmed that it always increments the voltage value corresponding to the actual web speed by a constant value or amount so that with respect to the input amperage of the motor 4 there will be a voltage curve in accordance with the line 17 in FIG. 2. The transmission of signals from the control device 11 to the motor 4 is illustrated in FIG. 1 by a signal conductor 21.

Figure 3:
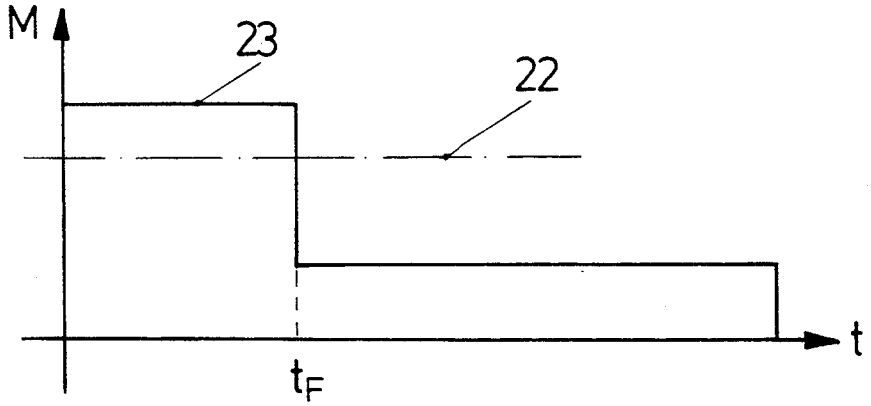
FIG. 3 is a graph in which motor torque is plotted against time.

The input amperage of the motor 4 influencing the torque able to be applied by the motor 4 is initially so set by the control device 11 via the signal conductor 21 that it has a maximum value which may if desired be greater than the permissible web tension. If the rolls 7 come into engagement with the roll 3, if the web should break, there will hence be a higher torque, which is able to accelerate the rolls 7. The web 1 will then be loose owing to the unavoidable elapse of time between the breaking of the web and the response of the web catching device so that the high torque does not present a danger for the web 1 at this moment. As soon as the rolls 7 are in cooperation with the roll 3, that is to say the web 1 has been caught, this being marked in the graphs of FIGS. 3 and 4 at $t_F$, the input amperage of the motor 4 will be reduced by the control device 11 to a value, which, as shown in FIG. 3, leads to a torque which is significantly lower than the permissible web tension as shown in FIG. 3 by broken lines 22. Accordingly there is the stepped torque curve as indicated by the full line 23 in FIG. 3, which at $t_F$, that is to say at the point in time of catching, is less than the permissible web tension. As from the point in time of catching, $t_F$, it is therefore impossible for the web 1 to be pulled from the web catching device again.

In order to determine the point in time of catching the web, that is to say the engagement of the rolls 7 with the roll 3, there is, as shown in FIG. 1 as well, a sensor 24 mounted in the frame 2 and which in the illustrated lowered working position of the yoke 6 bearing the rolls 7 produces an output signal, which is fed via a signal conductor 25 to the control device 11. The latter is so programmed that on the arrival of the sensor signal the amperage of the power supply to the motor 4 is reduced in the manner mentioned above. The programmed control device 11 may be provided with a microprocessor which renders the apparatus very versatile.

Figure 4:
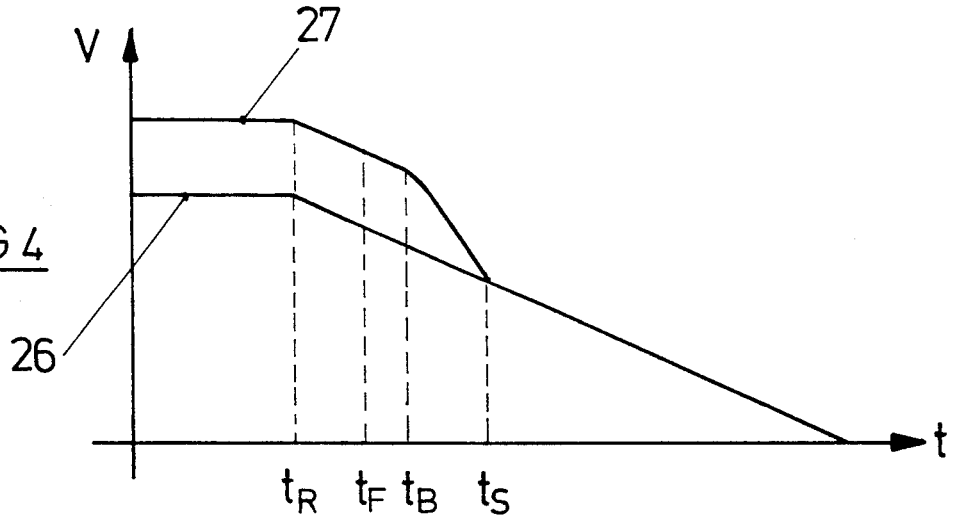
FIG. 4 is a graph in which the web or roll speed is plotted against time.

The speed of the printing press and hence of the web is, as shown in FIG. 4 at 26, practically constant as far as the point $t_R$ in time and then falls to zero. The speed indicated in FIG. 4 at 27 of the roll 3 is initially continued past $t_R$ as far as the point $t_F$ in time at the machine speed with the parallel shift corresponding to the overspeed set. From the point $t_F$ in time the web catching device will be, as already mentioned, in engagement with the web 1, which in this case is initially still loose so that only a small web tension (which does not exceed the low torque of the motor 4 effective as from the point $t_F$ in time) will act at the roll 3. The speed of the roll 3 will therefore, as shown in FIG. 4, extend somewhat past the point $t_F$ in time parallel to the machine speed. Since owing to the high overspeed of the roll 3 amounting to 15% the web will quickly be pulled taut, after the point $t_F$ the speed of the roll 3 will begin to very rapidly approach the web speed, as shown in the graph of FIG. 4 at $t_S$. At this point in time the web 1 is drawn taut to the normal tension. As from the point in time marked in FIG. 4 at $t_B$, as from which the speed of the roll 3 decreases more quickly than the speed of the web 1, the motor 4, which is practically set at a constant overspeed in relation to the speed of the web 1, is braked by the web tension. Since the torque able to be produced by the motor 4 is smaller than the breaking strength of the web, no breakage is possible.

Although a preferred embodiment of the invention has been described above in detail, this is to be without limiting effect on the possible scope of the invention. In fact the man in the art will have a large number of possibilities available to him in order to put the teaching of the invention into practice in accordance with the requirements of a particular case. Thus for instance it would be readily possible as well, in the case of a drive of the roll 3 derived from the drive of the printing press, to obtain the desired reduction of the transmittable torque by the use of a controlled clutch, as for instance a magnetic coupling, an eddy current coupling or the like, between the drive source and the roll 3.

I claim:

1. A method of catching a moving broken printing web, downstream of a printing unit of a roll feed rotary printing press, comprising the steps of:

providing a catching device including a driven roll and at least one yoke;

applying a torque to the roll to thereby run the roll at a circumferential speed higher than the speed of the web;

sensing a break in the web and generating a signal indicative of said break;

pivoting the yoke against the roll in response to said signal and thereby the web against the roll;

sensing the engagement of the yoke against the roll with the web therebetween; and reducing the circumferential speed of the roll such that the torque applied to the roll is less than the breaking tension of the web.

2. An apparatus for catching a moving broken printing web, downstream of a printing unit of a roll feed rotary printing press, comprising:

a frame;

a roll mounted to the frame to be rotatable;

drive means operatively associated with said roll to provide a torque to said roll and thereby an associated circumferential set speed to said roll, said speed being higher than the speed of the web;

at least one yoke pivotally mounted to said frame, said yoke being adapted to engage said roll;

means for sensing a break in the web and generating a signal indicative of said break;

means for sensing the engagement of said yoke with said roll with the web therebetween; and control means connected to said drive means, said means for sensing a break in the web and said means for sensing the engagement of said yoke with said roll, said control means serving to adjust said drive means to thereby reduce the torque applied to the roll by said drive means to be less than the breaking tension of the web and such that the circumferential speed of the roll is reduced below said set speed.

3. The apparatus as claimed in claim 2, wherein said drive means includes a variable torque transmission device comprising an electrical component with magnetic force transmission.

4. The apparatus as claimed in claim 3, wherein the variable torque transmission device comprises a drive motor preferably in the form of a three-phase serve motor which can be braked under load and is set to run with overspeed in relation to the speed of the web, the torque output of which can be reduced by the action of said control means in response to an input from said means for sensing the engagement of said yoke with said roll.

5. The apparatus as claimed in claim 3, wherein the voltage to the variable torque transmission device, which preferably comprises a drive motor, is increased to be greater than the voltage derived from the web speed so as to correspond to a constant value corresponding to the overspeed.

6. The apparatus as claimed in claim 5, further comprising:

a tachogenerator driven by the printing press and generating a signal proportional thereto, said signal being delivered to said control means; and means to increment the value of the voltage associated with said signal generated by said tachogenerator by a constant amount, wherein the voltage applied to the variable torque transmission device is proportional to the output signal of the tachogenerator.

7. The apparatus as claimed in claim 2, wherein the set speed of said roll is equal to at least 15% of said reduced speed.

8. The apparatus as claimed in claim 3, wherein the variable torque transmission device, which preferably comprises a drive motor, and wherein said control means preferably comprises a microprocessor.

9. The apparatus as claimed in claim 2, wherein said means for sensing a break in the web comprises a web break switch formed as a photoelectric detector for the edge of the web and a deflecting means associated with the latter for shifting the edge of the web in the adsence of web tension.

* * * * *